US005812686A

United States Patent [19]

Hobelsberger

[11] Patent Number: 5,812,686

[45] Date of Patent: Sep. 22, 1998

[54] DEVICE FOR ACTIVE SIMULTATION OF AN ACOUSTICAL IMPEDANCE

[76] Inventor: Maximilian Hans Hobelsberger, Dorfstr. 16, CH-5303 Würenlingen, Switzerland

[21] Appl. No.: 601,240

[22] Filed: Feb. 14, 1996

Related U.S. Application Data

[63] Continuation-in-part of Ser. No. 35,319, Mar. 22, 1993, abandoned.

[30] Foreign Application Priority Data

Mar. 24, 1992 [CH] Switzerland ..... 916/92

[51] Int. Cl.[6] ..... H04R 3/00

[52] U.S. Cl. ..... 381/96; 381/89; 381/159

[58] Field of Search ..... 381/96, 159, 89

[56] References Cited

U.S. PATENT DOCUMENTS

| | | | |
|---|---|---|---|
| 5,327,504 | 7/1994 | Hobelsberger | 381/96 |
| 5,461,676 | 10/1995 | Hobelsberger | 381/96 |

FOREIGN PATENT DOCUMENTS

| | | | |
|---|---|---|---|
| 4027511 C1 | 10/1991 | Germany . | |
| 0098096 | 5/1986 | Japan | 381/96 |
| 2122051 | 6/1982 | United Kingdom | 381/96 |
| WO 84/00274 | 1/1984 | WIPO | 381/96 |

*Primary Examiner*—Curtis Kuntz
*Assistant Examiner*—Ping W. Lee

[57] ABSTRACT

The device simulates actively an acoustical impedance. The simulation is achieved by sensing the air pressure on the surface of the membrane of an electrodynamic transducer and by moving the membrane with a speed and an acceleration which depend upon the pressure according to the desired impedance function. It can be used in loudspeaker systems with closed housings to eliminate standing waves inside housings.

17 Claims, 3 Drawing Sheets

DEVICE FOR ACTIVE SIMULTATION OF AN ACOUSTICAL IMPEDANCE

CROSS-REFERENCE TO RELATED APPLICATION

This application is a continuation-in-part of my earlier application, Ser. No. 08/035,319 filed Mar. 22, 1993 now abandoned. Foreign priority was claimed of the Swiss patent application No. 916/92-6 of Mar. 24, 1992.

BACKGROUND OF THE INVENTION

1. Field of the Invention

This invention relates to systems which absorb sound. More particularly, the invention relates to an active sound absorbing system.

2. Prior Art

In some applications in the field of acoustics devices are needed which reflect or absorb acoustical waves in a specified way. Often these devices should not reflect any acoustical waves.

At high frequencies this specified behaviour, e.g. no reflection, can be achieved by simple, passive constructive means, i.e. the of use absorptive materials like foam rubber or glass wool, and by giving the non-reflecting surface a special shape. However at low frequencies the dimensions of absorptive structures get large and impractical.

SUMMARY OF THE INVENTION

It is an object of this invention to provide means which actively absorb or reflect acoustical waves, whereby the characteristics of reflection can be adjusted. The devices according to the invention allow the active simulation of an acoustical impedance. By using these devices a specified behaviour of reflection can be achieved. Especially at low frequencies their dimensions are low in comparison to those of passive devices.

One important use of these devices is in loudspeaker systems to eliminate reflections and standing waves inside the housings of the loudspeaker systems.

The device consists of an electrodynamic transducer with a membrane driven by a coil which is placed in a magnetic field. The transducer transforms electrical energy into acoustical energy. Pressure sensing means, e.g. a pressure sensor, is mounted at the surface of the transducer's membrane to measure the air pressure at this location. The output signal of the sensing means is conveyed to a controller which controls via a power amplifier the movement of the transducer's membrane. The controller forces the membrane to move in reaction to the air pressure at the membranes surface according to the desired impedance function. It should be noted that no external signal is conveyed to the transducer, i.e. the system reacts solely to the pressure measured by the pressure sensing means.

So the momentary speed of the transducer's membrane depends predominantly on the momentary air pressure at the transducer's membrane according to the impendance function, and it depends only to a minor degree on any external signally. "Predominantly" and "to a minor degree" means in this context the following: Under ideal conditions the movement of the transducer's membrane would depend exclusively on the measured air pressure. And this dependancy is described by the chosen impendance function. However, under real conditions the movement of the membrane depends not only on the air pressure because the system reacts to external signally (e.g. noise, crosstalk) too and because components are inaccurate. "Predominantly" and "to a minor degree " means in this context that the actual speed of the membrane deviates from the ideal speed as described by the impendance function and the air pressure only to an extent tolerable to the application of the simulated impedance, i.e. so that the impedance is "accurate enough". A typical limit would be a deviation of the actual momentary speed from the ideal momentary speed of maximum ±20 % as long as the ideal speed values lie within the band of mormal operation of the system. As usual at very low values the noise will prevail, and at very high values strong distortions will arise.

For a fuller understanding of the nature of the invention, reference should be made to the following detailed description of the preferred embodiments of the invention, considered together with the accompanying drawings.

DESCRIPTION OF THE PREFERRED EMBODIMENTS

Figure 1:
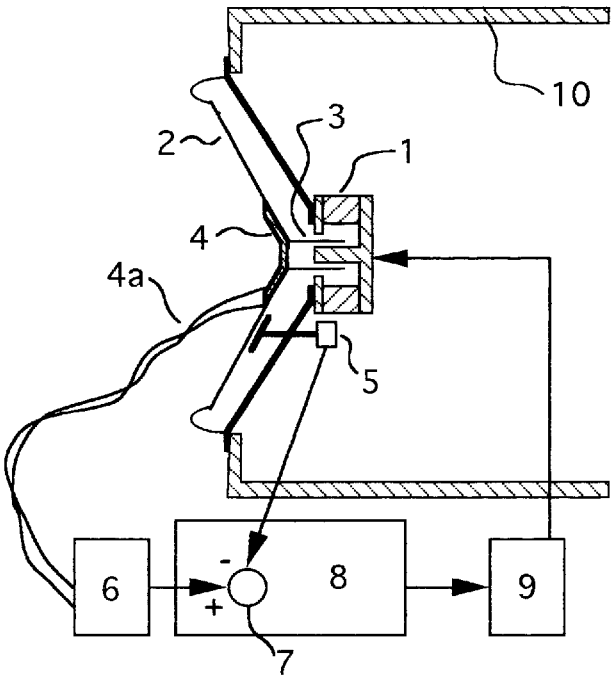
FIG. 1 is a schematic view of a system that is a preferred embodiment of the present invention.

The following is a description of a first embodiment of the invention and refers to FIG. 1.

The device consists of an electrodynamic transducer 1 with a membrane 2 driven by a coil 3 which is placed in a magnetic field. The transducer is built into wall means 10.

The membrane 2 is equipped with pressure sensing means at its front surface. The air pressure at the surface is measured by the sensing means. The signal produced by the sensing means is forwarded via wires 4*a* to a function block 6. In the function block 6 a calculation is performed using the pressure sensing means output value as input value for the calculation. Based on the momentary pressure value a momentary output value is calculated which is forwarded to the controllers 8 subtracting block 7. The calculated output value determines how fast the membrane of the transducer should move. It is used as the setpoint value for the closed loop control system, which consists of the controller 8 with its subtracting block 7, a power amplifier 9, the transducer 1 and measuring means to measure the membrane's movement 5, e.g. a speed sensor. The speed sensor measures the actual speed of the membrane 2. It should be understood that other sensors, e.g. acceleration sensors, can be used too to measure the movement of the membrane. The output of the speed sensor is connected to the other input of the subtracting block 7 so that the actual speed value is subtracted from the calculated speed value used as setpoint value. The resulting signal is conveyed to the controller which drives via the power amplifier the transducer's membrane. The controller is dimensioned to hold the membrane's momentary speed equal to the calculated momentary speed setpoint. That means that the membrane's momentary speed depends on the momentary pressure at the membrane's surface according to a chosen mathematical function. This function is the impedance function which describes the desired relation between the effective pressure at the membrane's surface and the speed of the air.

It should be understood that instead of operating just with the speed also other characteristic values of the membrane's movement, e.g. acceleration and position, can be measured and used by the controller to control the movement of the membrane. The calculator can also produce more setpoint signals for movement (e.g. acceleration, position) to determine the movement of the membrane.

The pressure sensing means can be either attached directly to the membrane, or, if mechanically more convenient, in distance from the membrane.

The calculator can be a digital or an analog type.

Figure 2:
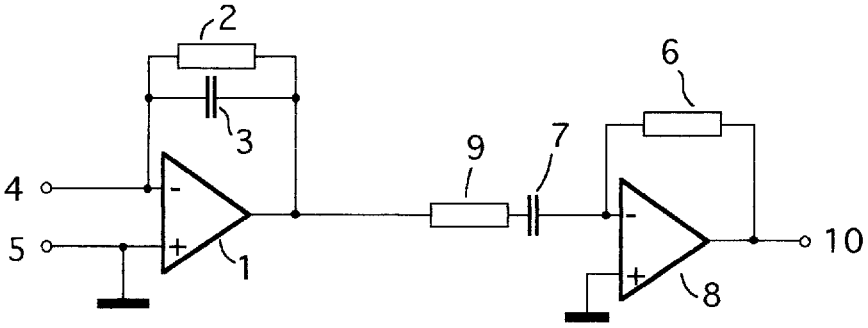
FIG. 2 shows an electronic, analog calculator, which is used in the embodiment.

A simple analog calculator is shown in FIG. 2. It consists of two operational amplifiers 1, 8, three resistors 2, 6, 9, and two condensers 3, 7.

The pressure sensor is connected to the inputs 4, 5 of the first amplifier 1. The circuit works as an integrator, which transforms the charge signal produced by the piezoelectric pressure sensor into a voltage signal which is proportional to the pressure changes. The resistor 2 limits the errors caused by the bias current of the operational amplifier 1. The value of 2 is large, e.g. 1MΩ. The second stage with the second operational amplifier cuts off DC-components with the large condenser 7 (e.g. 100 $\mu$F), inverts the signal and amplifies or reduces the signal coming from the output of the amplifier 1. The amplification or reduction factor is determined by the ratio of the resistors 9, 6: f=R6/R9. The factor is chosen that the calculated speed value equals the measured pressure change value divided by the value of the specific sound impedance: $v=p/(c\cdot\rho)$, where v is the calculated setpoint value for the speed of the membrane, c is the velocity of sound in air, p is the change of air pressure upon the surface, and ρ is the density of air. The pressure change is the difference between the time averaged air pressure and the momentary pressure: $p=p(t)-p_0$.

The output value of this circuit is conveyed to the non-inverting input of the control system as setpoint value of speed.

Preferably the material polyvinylidene fluoride, PVDF, or other piezoelectric polymers are used for pressure sensing means on the surface of the membrane.

Figure 3:
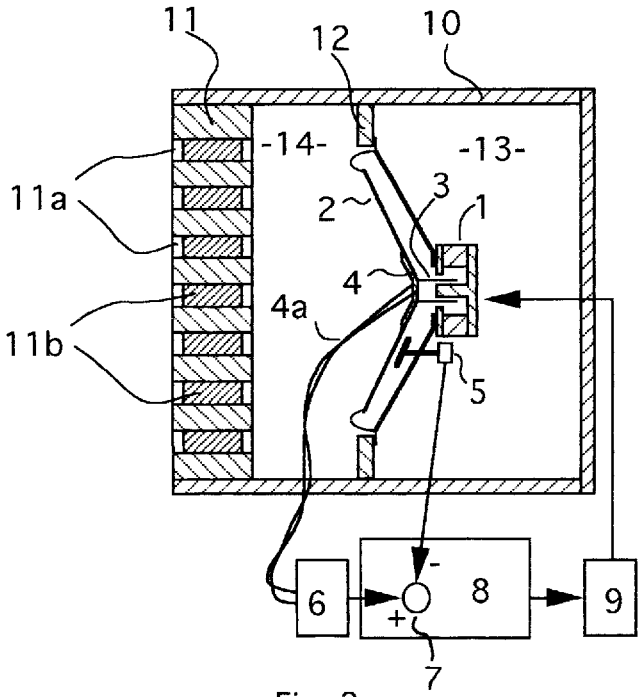
FIG. 3 shows a second embodiment of the invention.

The embodiment shown in FIG. 3 is a series combination of a passive and an active acoustical impedance. Typically the device consists of an e.g. cylindrical housing 10. The inner volume of the housing is divided into two chambers 13, 14 by a soundproof wall 12. An electrodynamic transducer 1 is built into an opening of this wall. The membrane 2 of the transducer separates the two chambers 13, 14 from each other. The membrane is equipped with pressure sensing means 4 and acts together with a calculator 6, a controller 8 with its subtracting circuit 7, and a power amplifier 9 as active acoustical impedance. The controller controls the movement of the membrane according to the impedance function and the measured pressure. Speed and acceleration sensors 5 give the controller information about the membrane's movement. The inner chamber 14 which adjoins the surface of the membrane's pressure sensor is connected to the outer space via openings 11*a* in the front wall 11 of the casing. These openings are shaped and stuffed with sound absorbing material 11*b* in a way, that sound with higher frequencies is absorbed. Sound with lower frequencies can pass this filter. It will be reflected or absorbed by the active impedance according to the desired impedance function. The advantage of this series arrangement is that the control loop is not excited by high frequencies.

Figure 4:
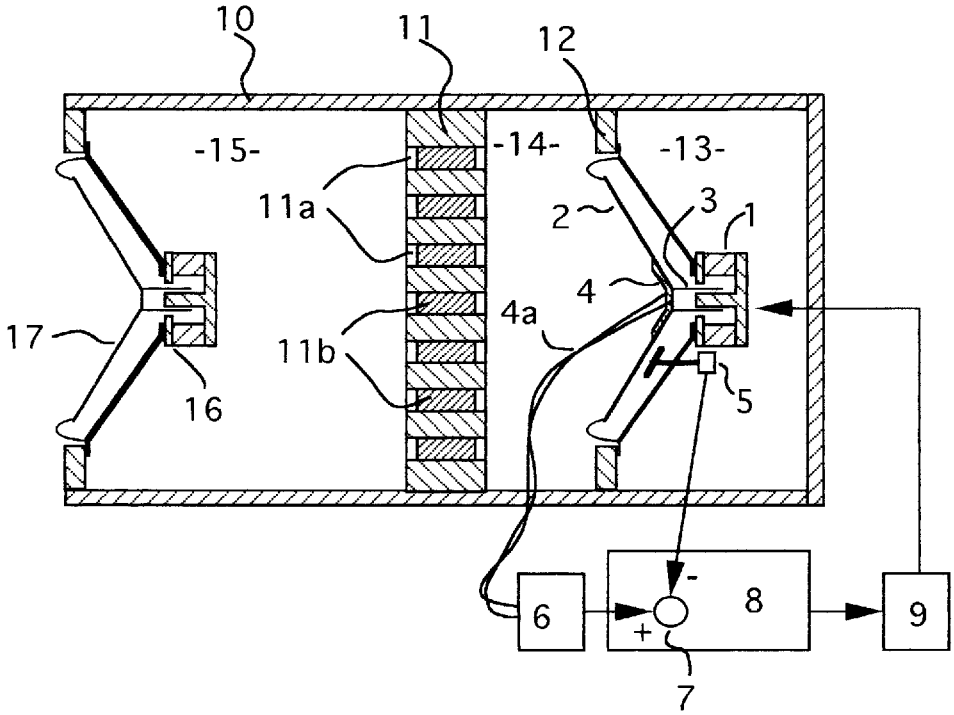
FIG. 4 shows the system being employed in a loudspeaker system.

FIG. 4 shows the application of the invented devices in loudspeaker systems. The devices are used to eliminate standing waves and sound reflections inside the housing.

The loudspeaker system consists of a closed loudspeaker-system housing 10, which is e.g. pipe shaped. A loudspeaker 16, with its membrane 17, is built into an opening of this housing. The device for simulation of an acoustical impedance is built in that it influences the pressure inside the housing. The inner volume of the housing is divided into three chambers 13, 14, 15 by two soundproof walls 11, 12. An electrodynamic transducer 1 is built into an opening of the wall 12. The membrane 2 of the transducer separates the two chambers 13, 14 from each other. The membrane is equipped with pressure sensors 4, connection wires 4*a*, and acts together with a calculator 6, a controller 8 with its subtracting circuit 7, and a power amplifier 9 as active acoustical impedance. The controller controls the movement of the membrane according to the impedance function and the measured pressure. Speed and acceleration sensors 5 give the controller information about the membrane's movement.

The other inner wall 11 separates the chamber 14 and 15. The chamber 14 which adjoins the surface of the membrane's pressure sensor 4 is connected to the chamber 15 which adjoins the loudspeakers membrane 17 via openings 11*a* in the wall 11. These openings are shaped and stuffed with sound absorbing material 11*b* in a way, that sound with higher frequencies is absorbed.

The impedance function of the simulated acoustical impedance is chosen to be $v=p/(c\cdot\rho)$. That means that an opening in the wall through which the waves can pass is simulated. Therefore the acoustical waves with low frequencies will not be reflected, and waves with high frequencies will be absorbed by the sound absorbing material in the wall. It should be noted that other impedance functions could be chosen too.

While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come within the true spirit and scope of this invention.

Figure 5:
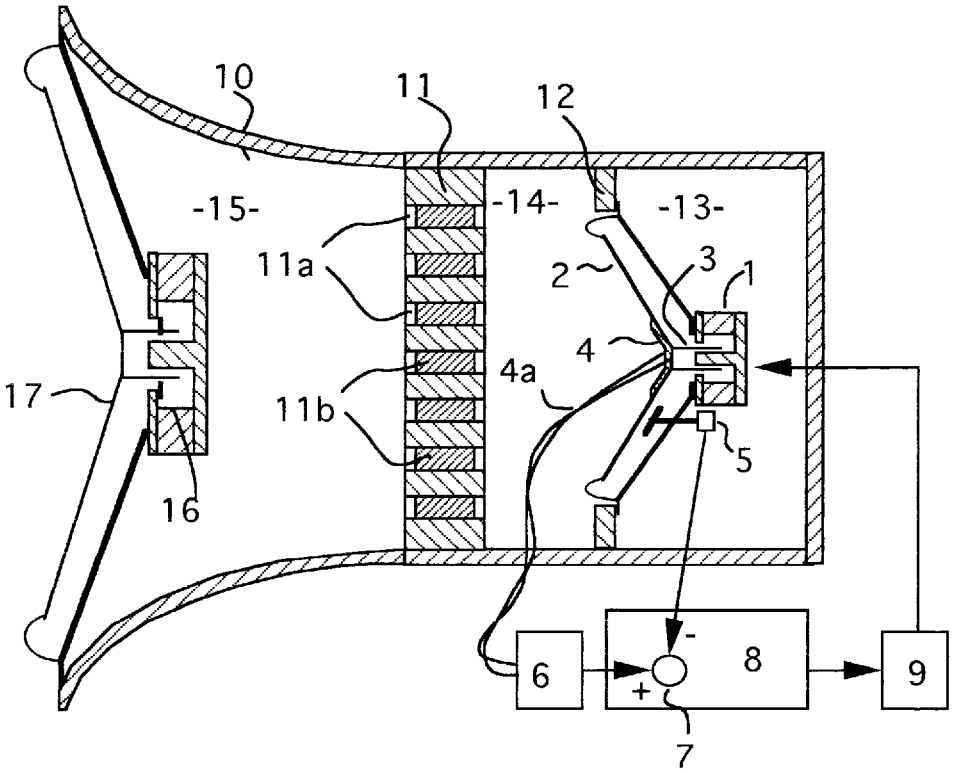
FIG. 5 shows a specially shaped loudspeaker system.

FIG. 5 shows the same system as FIG. 4 with the same components: The loudspeaker-system housing 10, the loudspeaker 16 with its membrane 17, the three chambers 13, 14, 15, the two soundproof walls 11, 12, the electrodynamic transducer 1 with its membrane 2, the pressure sensors 4, speed and acceleration sensors 5, connection wires 4*a*, the calculator 6, the controller 8 with its subtracting circuit 7, the power amplifier 9, openings 11*a* in the wall 11, stuffed with sound absorbing material 11*b*. The housing 10 is shaped like a pipe, whereby the pipe has a changing diameter.

What is claimed is:

1. Device to simulate a selectable acoustical impedance, comprising:

an electrodynamic transducer, for transformation of electrical energy into acoustical energy by movement of said transducer's membrane, wall means, into an opening of which said transducer is built that said transducer's membrane closes said opening, for dampening the influence of the acoustical waves radiated by the rear surface of said transducer's membrane on the acoustical waves produced by the front surface of said transducer's membrane, pressure-sensing means, mounted at said front surface of said transducer's membrane, for measuring the air pressure and for producing signals indicative of this air pressure, calculating means, to the input of which the signals produced by said pressure sensing means are applied, for calculating output signals based on the value of said signals from the pressure sensing means according to a mathematical function, whereby the dependancy of the momentary value of the calculated output signals on the momentary value of said signals from the pressure sensing means is governed by said mathematical function, a closed loop control system, comprising:

measuring means for measuring the momentary values of movement of said transducer's membrane and for producing signals indicative of these values, a power amplifier, the output of said amplifier being connected to said electrodynamic transducer to drive said transducers membrane;

an electrical controller, to the inputs of which the signals produced by said calculating means and the signals produced by said movement measuring means are applied, whereby said signals produced by said calculating means are applied as setpoint values for said membrane's movement's values, the output of said controller being connected to the input of said power amplifier to drive the amplifier, and said controller being dimensioned to force said transducer's membrane to move according to the calculated, momentary setpoint values for said membrane's movement in order to achieve equality between said measured momentary values of said membrane's movement and said momentary setpoint values produced by said calculating means so that the momentary speed of the transducer's membrane depends predominantly on the momentary air pressure at said transducer's membrane according to said mathematical function and to a minor degree on any other external signal.

2. Device according to claim 1, in which said wall means constitute an acoustically closed housing, whereby said front surface of said transducer's membrane faces outwards of said housing.

3. Device according to claim 2, in which in front of said front surface of said transducer's membrane second wall means are arranged creating a chamber which adjoins to said front surface of said transducer's membrane, whereby said wall means are equipped with holes, which connect the inside of said chamber, which adjoins to said front surface of said transducer's membrane, to the outside, whereby said holes are so constructed and so stuffed with a fibrous or foamy material, that sound and pressure are transferred through these holes between the inside and the outside of said chamber according to a transfer function with low pass characteristics.

4. A loudspeaker system for improved bass reproduction, comprising the device for simulation of an acoustical impedance according to claim 1, and further comprising a loudspeaker-system housing and a loudspeaker being mounted in an opening of the loudspeaker-system housing;

whereby the device for simulation of an acoustical impedance is mounted with said front surface of said transducer's membrane adjoining the inside of said loudspeaker-system housing so that the air pressure inside the loudspeaker-system housing is influenced by the device for simulation of an acoustical impedance.

5. Loudspeaker system of claim 4, in which said loudspeaker-system housing is shaped like a pipe, whereby said loudspeaker is mounted at one end of the pipe, and whereby said device for simulation of an acoustical impedance is located at the other end of the pipe.

6. A loudspeaker system for improved bass reproduction, comprising the device for simulation of an acoustical impedance according to claim 3, and further comprising a loudspeaker-system housing and a loudspeaker being mounted in an opening of the loudspeaker-system housing;

whereby the device for simulation of an acoustical impedance is mounted with said hole-equipped wall means adjoining the inside of said loudspeaker-system housing so that the air pressure inside the loudspeaker-system housing is influenced by the device for simulation of an acoustical impedance.

7. Loudspeaker system of claim 6, in which said loudspeaker-system housing is shaped like a pipe, whereby said loudspeaker is mounted at one end of the pipe, and whereby said device for simulation of an acoustical impedance is located at the other end of the pipe.

8. A loudspeaker system for improved bass reproduction, comprising the device for simulation of an acoustical impedance according to claim 2, and further comprising a loudspeaker-system housing and a loudspeaker being mounted in an opening of the loudspeaker-system housing;

whereby the device for simulation of an acoustical impedance is mounted with said front surface of said transducer's membrane adjoining the inside of said loudspeaker-system housing so that the air pressure inside the loudspeaker-system housing is influenced by the device for simulation of an acoustical impedance.

9. Loudspeaker system of claim 8, in which said loudspeaker-system housing is shaped like a pipe, whereby said loudspeaker is mounted at one end of the pipe, and whereby said device for simulation of an acoustical impedance is located at the other end of the pipe.

10. Device according to claim 1, in which in front of said front surface of said transducer's membrane second wall means are arranged creating a chamber which adjoins to said front surface of said transducer's membrane, whereby said wall means are equipped with holes, which connect the inside of said chamber, which adjoins to said front surface of said transducer's membrane, to the outside, whereby said holes are so constructed and so stuffed with a fibrous or foamy material, that sound and pressure are transferred through these holes between the inside and the outside of said chamber according to a transfer function with low pass characteristics.

11. A loudspeaker system for improved bass reproduction, comprising the device for simulation of an acoustical impedance according to claim 10, and further comprising a loudspeaker-system housing and a loudspeaker being mounted in an opening of the loudspeaker-system housing;

whereby the device for simulation of an acoustical impedance is mounted with said hole-equipped wall means adjoining the inside of said loudspeaker-system housing so that the air pressure inside the loudspeaker-system housing is influenced by the device for simulation of an acoustical impedance.

12. Loudspeaker system of claim 11, in which said loudspeaker-system housing is shaped like a pipe, whereby said loudspeaker is mounted at one end of the pipe, and whereby said device for simulation of an acoustical impedance is located at the other end of the pipe.

13. Device according to claim 1, in which these pressure sensing means are directly attached to said front surface of said transducer's membrane.

14. Device according to claim 1, in which the pressure sensing means are mounted in distance from said transducer's membrane's front surface.

15. A loudspeaker system for improved bass reproduction, comprising a loudspeaker-system housing and a loudspeaker being mounted in an opening of the loudspeaker-system housing;

and a device to simulate a selectable acoustical impedance, comprising an electrodynamic transducer, for transformation of electrical energy into acoustical energy by movement of said transducer's membrane, wall means, into an opening of which said transducer is built that said transducer's membrane closes said opening, for dampening the influence of the acoustical waves radiated by the rear surface of said transducer's membrane on the acoustical waves produced by the front surface of said transducer's membrane, pressure-sensing means, mounted at said front surface of said transducer's membrane, for measuring the air pressure and for producing signals indicative of this air pressure, calculating means, to the input of which the signals produced by said pressure sensing means are applied, for calculating output signals based on the value of said signals from the pressure sensing means according to a mathematical function, whereby the dependancy of the momentary value of the calculated output signals on the momentary value of the said signals from the pressure sensing means is governed by said mathematical function, a power amplifier, the output of said amplifier being connected to said electrodynamic transducer to drive said transducer's membrane;

an electrical controller which controls the movement of the transducer's membrane, to the inputs of which the signals produced by said calculating means are applied as setpoint values for said membrane's movement's values, the output of said controller being connected to the input of said power amplifier to drive the amplifier, and said controller being dimensioned to force said transducer's membrane to move according to the calculated, momentary setpoint values for said membrane's movement in order to achieve equality between the actual momentary values of said membrane's movement and said momentary setpoint values for movement produced by said calculating means so that the momentary speed of the transducer's membrane depends predominantly on the momentary air pressure at said transducer's membrane according to said mathematical function and only to a minor degree on any external signal, whereby the device for simulation of an acoustical impedance is mounted with said front surface of said transducer's membrane adjoining the inside of said loudspeaker-system housing so that the air pressure inside the loudspeaker-system housing is influenced by the device for simulation of an acoustical impedance.

16. Device according to claim 15, in which these pressure sensing means are directly attached to said front surface of said transducer's membrane.

17. Device according to claim 15, in which the pressure sensing means are mounted in distance from said transducer's membrane's front surface.

* * * * *